US008479694B2

(12) United States Patent
Manther et al.

(10) Patent No.: US 8,479,694 B2
(45) Date of Patent: Jul. 9, 2013

(54) SWITCHABLE ROLLER FINGER FOLLOWER

(75) Inventors: Debora Manther, Royal Oak, MI (US); Jeff Villemure, Westland, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 344 days.

(21) Appl. No.: 13/025,292

(22) Filed: Feb. 11, 2011

(65) Prior Publication Data

US 2011/0197842 A1 Aug. 18, 2011

Related U.S. Application Data

(60) Provisional application No. 61/304,009, filed on Feb. 12, 2010.

(51) Int. Cl.
*F01L 1/34* (2006.01)

(52) U.S. Cl.
USPC ..... 123/90.16; 123/90.39; 123/90.44; 74/559; 74/567; 74/569; 29/888.2

(58) Field of Classification Search
USPC ..... 123/90.16, 90.39, 90.44; 74/559, 74/567, 569; 29/888.2
See application file for complete search history.

(56) References Cited

U.S. PATENT DOCUMENTS 7,305,951 B2 * 12/2007 Fernandez et al. ..... 123/90.39
2003/0209217 A1 * 11/2003 Hendriksma et al. ..... 123/90.44

* cited by examiner

*Primary Examiner* — Kenneth Bomberg
*Assistant Examiner* — Jason T Newton
(74) *Attorney, Agent, or Firm* — Lucas & Mercanti, LLP

(57) ABSTRACT

The finger follower employs two independent lost motion arms and a rod which moves longitudinally to lock both arms. The rod is transversely mounted in the follower. In order to avoid premature locking, each arm has a chamfered surface on a top wall to force the rod out of engagement with the arm during upward movement of the arms, to protect premature movement of the rod from an unlocked position to a locked position.

6 Claims, 4 Drawing Sheets

SWITCHABLE ROLLER FINGER FOLLOWER

FIELD OF INVENTION

This Invention relates to internal combustion engines and more particularly to switchable roller finger followers used in overhead cam engines where the finger followers can be deactivated in order to deactivate an intake and/or exhaust valve.

BACKGROUND OF INVENTION

Switchable roller finger followers are known, see, for example, U.S. Pat. No. 7,174,869. Such finger followers have an outer lever pivotably mounted outside an inner lever and a roller rotatably mounted in a slot in the inner liner. The top surface of the outer lever acts as a contact surface for a high lift cam and the top surface of the roller acts as a contact surface for a low lift cam. A coupling element is mounted on one end of the finger and oil from an oil source is used to activate the coupling element. When the coupling element is activated, it locks the outer lever to the inner lever and requires the follower to follow both the high lift cam and the low lift cam. When the coupling element is deactivated, the outer lever is free to pivot and, under the aid of a spring, the outer lever pivots freely in conjunction with the high lift cam. This movement by the outer lever is conventionally referred to as the lost motion stroke. The outer lever is in a base position when it is locked by the coupler.

Conventionally, the outer lever is a unitary structure such that the coupling element need only operate on one part of the outer lever. Typically, the coupling device operated on a yoke portion of the outer layer, the yoke portion being transverse to the longitudinal axis of the finger follower.

SUMMARY OF INVENTION

The Invention is directed to a finger follower where the outer lever is designed as two separate outer arms, which are not joined by a transverse yoke and which can freely move independent of one another and a coupling element that operates on both arms simultaneously to simultaneously lock both arms.

Also, the Invention provides a coupling element that can be activated at any point during the pivotal movement of the arms, at any point during the lost motion stroke, but that locks the arms only when the arms are in a base position.

The Invention can be defined as, a switchable finger follower of the type having two separate outer arms pivotally mounted at one end of an inner lever, a roller rotatably mounted in a slot in the inner lever, the outer arms extending longitudinally towards the other end of the inner lever, a restoring spring means for restoring the arms to a base position and a coupling element mounted in the other end of the inner lever, wherein the coupling element has a rod extending transversely from each side wall of the inner lever and the rod is longitudinally movable into and out of engagement with a locking surface on a bottom wall at the other end of each of the arms, to lock and unlock the arms in a base position; and a chamfered contact surface on a top wall at the other end of each of the arms to force the rod longitudinally towards the other end of the lever when the chamfered contact surfaces contacts the rod.

When the chamfered contact surface on the top wall of the arm contacts the rod during an upward stroke of the arm, the rod is moved longitudinally towards the other end of the lever so that the arm can move past the rod. Once the arm moves past the rod, the rod moves longitudinally towards the one end of the lever and the rod makes contact with the locking surface of the arm to lock the arm in the base position.

As can be appreciated, the angle of the chamfered surface with respect to the angle or orientation of the oblong hole and the upward force provided by the restoring spring means on the arm exceeds the frictional forces and the longitudinal force of the coupling element on the rod, so that the rod is moved longitudinally by the upward motion of the arm due to the interaction between the chamfered surface on the top wall of the arm and the rod.

Broadly, the Invention can be defined as follows:

A switchable finger follower for a valve train of an internal combustion engine, comprising:

a longitudinally extending, inner lever having a bottom wall with a valve stem support at one end of the lever and a lash adjuster contact surface at the other end of the lever and a slot extending through the lever from the bottom wall to a top wall of the lever;

a roller mounted in the slot;

two separate, longitudinally extending outer arms, one end of each of the arms pivotally mounted at the one end of the lever, one of each of the arms mounted along one of each longitudinal sidewalls of the lever and the other end of each of the arms extending towards the other end of the lever, each of the arms moving between a down position and a base position;

a restoring spring means for restoring the arms from the down position to the base position; and a coupling element mounted in a transverse end wall at the other end of the lever, the coupling element having a rod extending transverse from each of the longitudinal sidewalls of the inner lever, the rod longitudinally movable into and out of engagement with a locking surface on a bottom wall at the other end of each of the arms, to lock and unlock the arms in the base position; and a chamfered contacts surface on a top wall at the other end of each of the arms, to force the rod longitudinally towards the other end of the lever when the chamfered contact surface contacts the rod and the arm moves from the down position to the base position.

Preferably, the coupling element comprises:

a longitudinal extending blind bore extending from a transverse end wall at the other end of the lever into the lever;

a transverse, oblong hole extending from one of longitudinal sidewalls to the other of the longitudinal sidewalls of the lever, the oblong hole transversely bisecting the blind bore;

the rod mounted in the oblong hole to transversely bisect the blind bore;

a spring mounted in the blind bore at the blind end;

a longitudinally movable piston mounted in the blind bore on top of the spring, the piston, engaged with the rod and longitudinally movable therewith; and an end cap closing an open end of the blind bore and forming a chamber between the end cap and the piston for receiving fluid pressure, such that the fluid pressure forces the piston to move longitudinally in the blind bore which longitudinally moves the rod into engagement with the other end of the arms.

Preferably, the chamfered surface on the top wall at the other end of each of the arms is directly above the locking surface on the bottom wall at the other end of each of the arms. More preferably, the chamfered surface and the locking surface are separated from each other by a transverse end wall at the other end of each of the arms.

Preferably, two press fit clips are fitted to the rod, adjacent the longitudinal sidewalls of the lever to maintain the position of the rod in a transverse direction.

Preferably, the restoring spring means is two restoring springs which are each a torsion spring, each spring is mounted on a post extending transversely outward from each of the longitudinal sidewalls, and each spring has a long leg which abuts the arm and a short leg that abuts a stop, the stop is affixed to sidewalls of the lever.

The upward force exerted by the restoring spring means, and more specifically the longitudinal vector of the force provided by the chamfered surface to the rod is greater than the longitudinal vector of force provided by the fluid pressure against the piston such that the arm moves the rod longitudinal in the oblong hole towards the other end of the lever.

These and other aspects of the Invention may be more readily understood by reference to one or more of the following drawings.

DETAILED DESCRIPTION OF THE INVENTION

Figure 1:
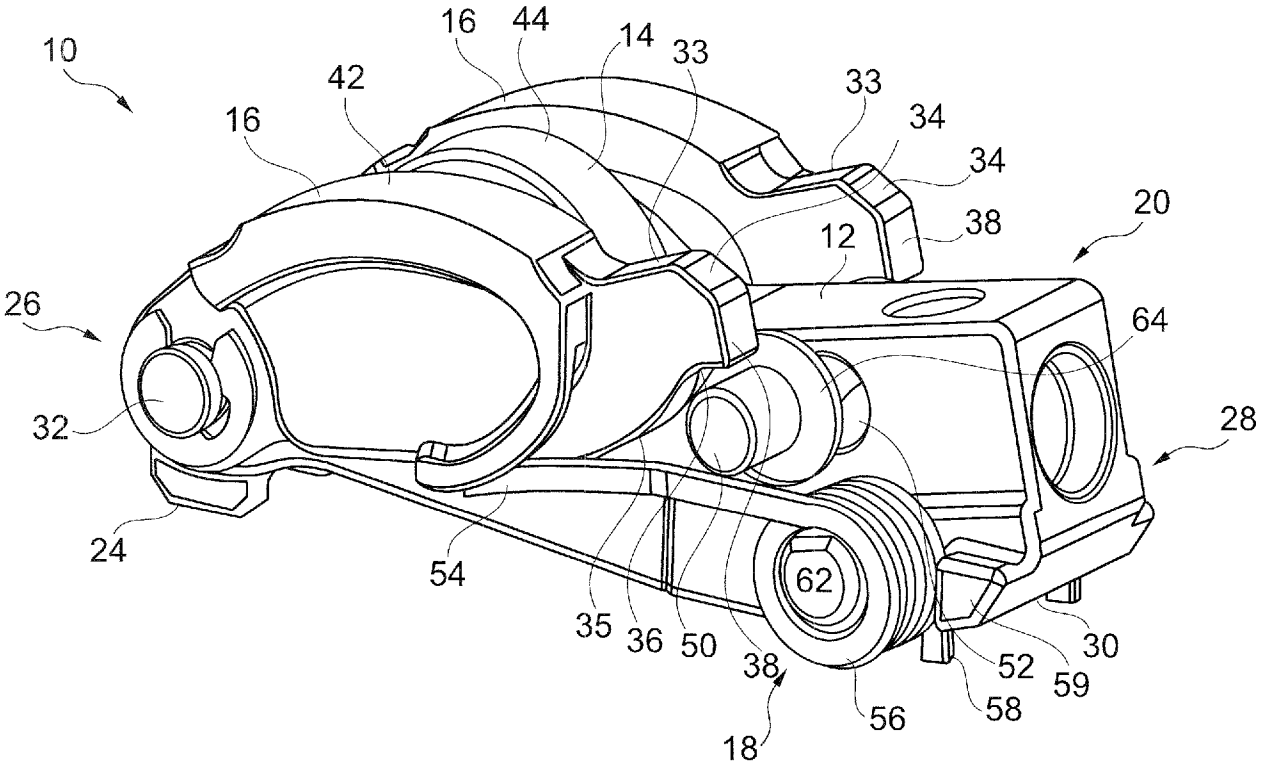
FIG. 1 is a perspective view of the finger follower of the Invention.

FIG. 1 illustrates switchable finger follower 10 having inner lever 12 in which roller 14 is mounted and outer arms 16 which are acted on by torsion spring 18. Coupler element 20 can lock arms 16 in a base position, as illustrated in FIG. 4 or can allow arms 16 to freely pivot between the base position as shown in FIG. 4 and the down position as illustrated in FIG. 5A.

Figure 3:
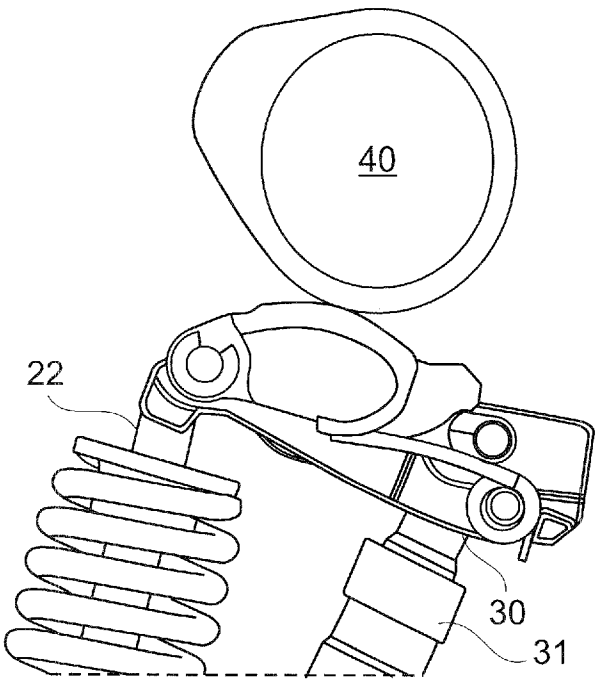
FIG. 3 is a side view of the finger follower in the unlocked mode.

Finger follower 10 operates on valve stem 22, see FIG. 3, and has valve stem support 24 located at valve stem end 26. Lash adjuster end 28 of finger follower 10, has lash adjuster contact surface 30 which is operated on by lash adjuster 31, see FIG. 3. Rod 32 allows for the pivoting action of arms 16. Arms 16 have top wall 33 with chamfered surface 34 and bottom wall 35 with locking surface 36. Between chamfered surface 34 and locking surface 36 is transverse end wall 38. In one embodiment, end wall 38 is arched having a radius centered about the pivot point to maximize the length of locking surface 36.

Cam 40, see FIG. 3, operates on cam contact surface 42 of arms 16 and cam contact surface 44 of roller 14.

Figure 4:
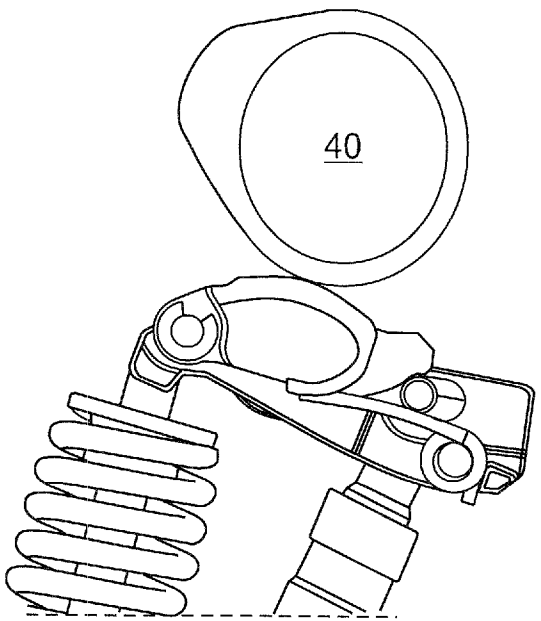
FIG. 4 is a side view of the finger follower in the locked mode.
Figure 5B:
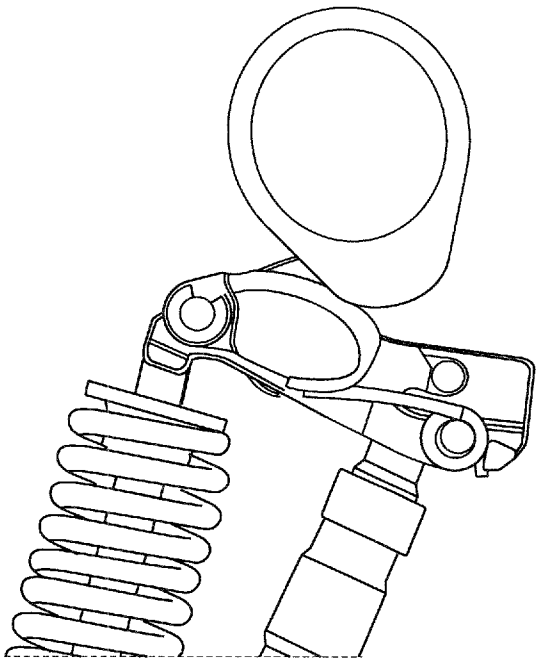
FIG. 5A-5B illustrates the arms moving the rod longitudinal rearward.
Figure 5A:
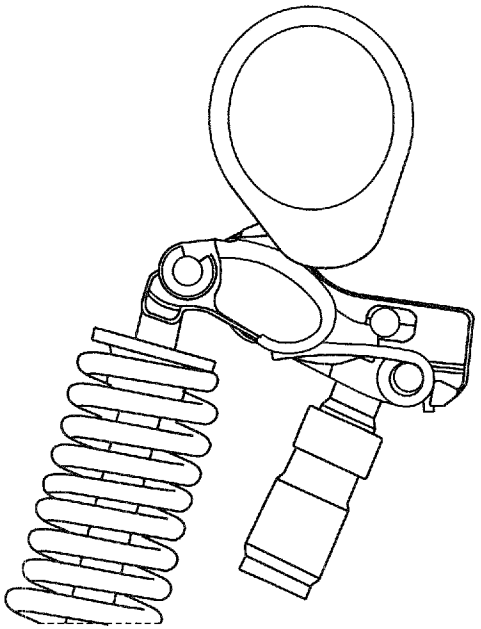

In order to lock arms 16 in the base position, as illustrated in FIG. 4, rod 50 is longitudinally movable in oblong hole 52. Oil pressure is used to move rod 50 in oblong hole 52 towards valve stem end 26 of follower 10. The oil escapes when oil pressure is released from acting on rod 50. Spray hole 53 lubricates slider pad. Oil sprays cam 40 and is transferred to the pad.

Figure 2:
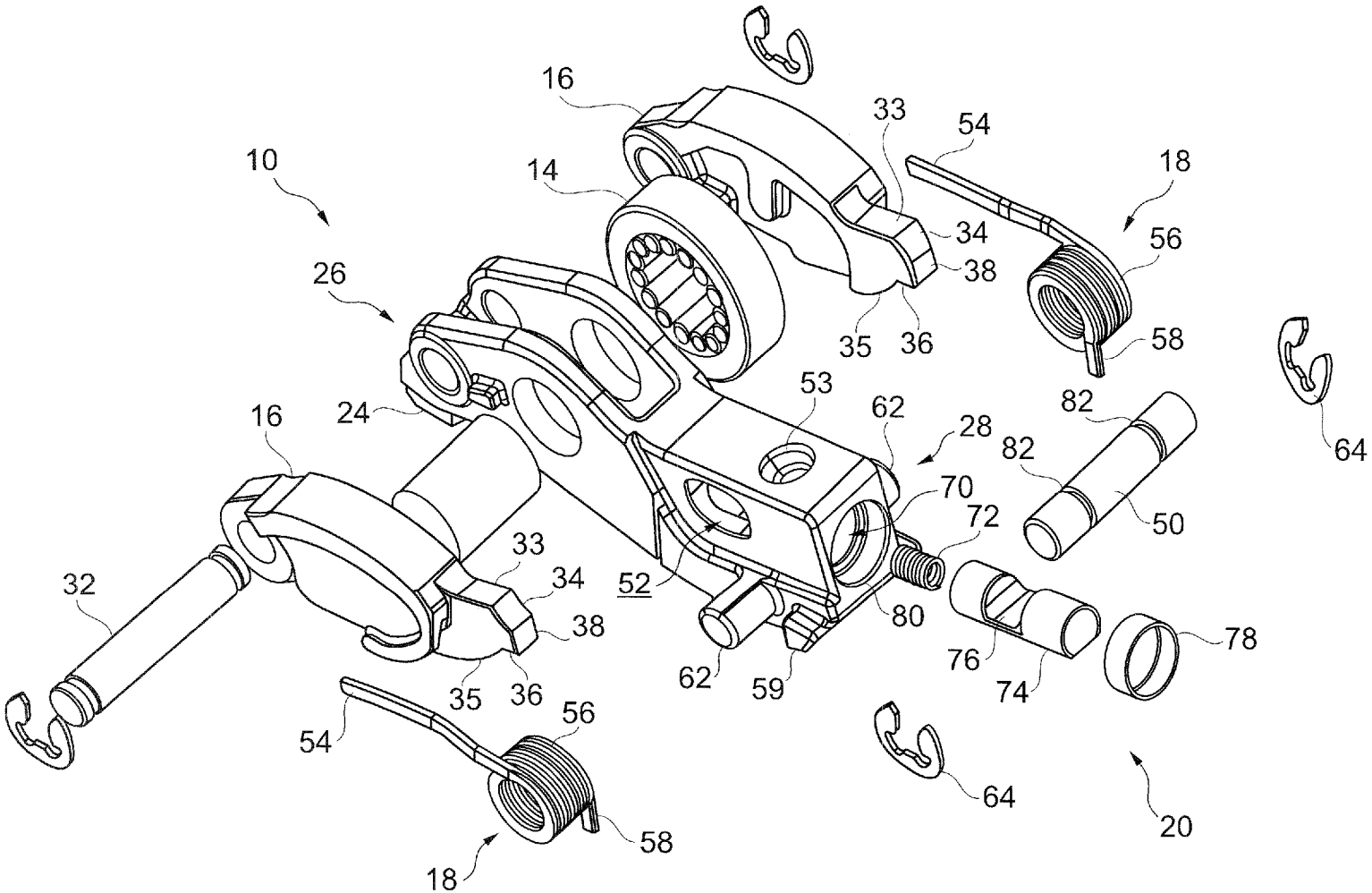
FIG. 2 is an exploded view of the finger follower of the Invention.

Torsion spring 18 has long leg 54, coils 56 and short leg 58. Long leg 54 acts on contact surface 60 of arm 16. Post 62 is used for mounting torsion spring 18 and stop 59 acts as a stop for short leg 58. Washer 64 maintains rod 50 centrally positioned in oblong hole 52. FIG. 2 illustrates an exploded view of finger follower 10. Coupling element 20 comprises blind bore 70 having coil spring 72, piston 74, cut out 76 in piston 74 for housing of rod 50, end cap 78 abuts the end of piston 74 and provides contact surface for oil pressure coming through inlet 80. Washer 64 is held on rod 50 by press fit.

As illustrated in FIG. 3, cam 40 operates on arms 16 and roller 14 to move arms 16 and finger follower 10 up and down.

As illustrated in FIG. 4, in order to lock arms 16 in a base position, rod 50 moves longitudinally in oblong hole 52 so as to contact locking surface 36 on arm 16.

Oil pressure through a conventional oil pressure supply system is provided through lash adjuster 31 into lash adjuster contact surface 30 and into internal chamber 79 formed between end cap 78 and the other end of movable piston 74 when end cap 78 is fitted into opening 80. This oil pressure moves rod 50 longitudinally, which is housed in cut out 76.

When rod 50 has been moved longitudinally and arm 16 is in the down position, as illustrated in FIG. 5A, chamfered surface 34 comes into contact with rod 50 as illustrated in FIG. 5A. Because of the force of torsion spring 18 on arm 16 and the angle of surface 34, rod 50 is moved in a longitudinal manner towards the lash adjuster end 28 of finger follower 10. This allows arm 16 to move past rod 50. Once arm 16 has moved past rod 50, the oil pressure provided to chamber 79 allows rod 50 to move longitudinally in oblong hole 52 towards valve stem end 28 of finger follower 10, thus, allowing rod 50 to contact locking surface 36 of arm 16 as illustrated in FIG. 4.

When oil pressure is released from chamber 79, return spring 72 moves piston 74 and rod 50 longitudinal towards lash adjuster end 28 of lever 12.

Thus, chamfered surface 34 corrects for mis switch conditions and allows for proper locking of arm 16.

REFERENCE CHARACTERS

10 Switchable finger follower
12 inner lever
14 roller
16 outer arms
18 torsion springs
20 coupling element
22 valve stem
24 valve stem support
26 valve stem end
28 lash adjuster end
30 lash adjuster contact surface
31 lash adjuster
32 rod
33 top wall
34 chamfered surface
35 bottom wall
36 locking surface
38 transverse end wall
40 cam
42 cam contact surface arms
44 cam contact surface roller
50 rod
52 oblong hole
53 spray hole
54 long leg
56 coil
58 short leg
59 end stop
60 contact surface
62 post
64 washer
70 blind bore

72 coil spring
74 piston
76 cut out
78 end cap
79 chamber
80 opening

What we claim is:

1. A switchable finger follower for a valve train of an internal combustion engine, comprising:

a longitudinally extending, inner lever having a bottom wall with a valve stem support at one end of the lever and a lash adjuster contact surface at the other end of the lever and a slot extending through the lever from the bottom wall to a top wall of the lever;

a roller mounted in the slot;

two separate, longitudinally extending outer arms, one end of each of the arms pivotally mounted at the one end of the lever, one of each of the arms mounted along one of each longitudinal sidewalls of the lever and the other end of each of the arms extending towards the other end of the lever, each of the arms moving between a down position and a base position;

a spring for restoring the arms from the down position to the base position;

a coupling element mounted in a transverse end wall of the other end of the lever, the coupling element having a rod extending transversely from each of the longitudinal sidewalls of the inner lever, the rod longitudinally movable into and out of engagement with a locking surface on a bottom wall, at the other end, of each of the arms to lock and unlock the arms in the base position; and a chamfered contact surface on a top wall, at the other end of each of the arms to force the rod longitudinally towards the other end of the lever where the chamfered contact surface contacts the rod and the arms move from the down position to the base position.

2. The follower of claim 1, wherein the coupling element comprises:

a longitudinally extending blind bore extending from the transverse end wall of the other end of the lever into the lever;

a transverse, oblong hole extending from one of the longitudinal sidewalls to the other of the longitudinal sidewalls of the lever, the oblong hole transversely bisecting the blind bore;

the rod mounted in the oblong hole to transversely bisect the blind bore;

a spring mounted in the blind bore at the blind end; and a longitudinally movable piston mounted in the blind bore on top of the spring, the piston engaged with the rod and longitudinally movable therewith.

3. The follower of claim 1, wherein the chamfered surface is directly above the locking surface on each of the arms.

4. The follower of claim 1, wherein the chamfered surface is separated from the locking surface by an arched, transverse end wall on each of the arms.

5. The follower of claim 1, wherein the spring includes two restoring springs mounted at the other end of the lever, one of each of the springs acting on one of each of the arms to restore the arms to the base position from the down position.

6. The follower of claim 5, wherein the two restoring springs are each a torsion spring, each spring is mounted on a post extending transversely outward from each of the longitudinal sidewalls, and each spring has a long leg which abuts the arm and a short leg that abuts a stop, the stop affixed to the lever.

* * * * *